US006234835B1

(12) United States Patent
Bakker et al.

(10) Patent No.: US 6,234,835 B1
(45) Date of Patent: May 22, 2001

(54) REMOVABLE CONNECTOR EDGE CLIP

(75) Inventors: John H. Bakker, Cortland; Ronald A. Puhl, Warren, both of OH (US); Vickey E. Reed, Beaver Falls, PA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/482,200

(22) Filed: Jan. 12, 2000

(51) Int. Cl.[7] ..... H01R 13/73; H01R 4/66; H01R 13/648

(52) U.S. Cl. ..... 439/553; 439/92

(58) Field of Search ..... 439/553, 575, 439/92; 361/801; 24/73 HS; 238/351

(56) References Cited

U.S. PATENT DOCUMENTS 3,631,569 * 1/1972 Seckerson et al. ..... 24/73 HS
5,148,981 * 9/1992 Lynch, Jr. et al. ..... 238/351

* cited by examiner

*Primary Examiner*—Lincoln Donovan
*Assistant Examiner*—Chandrika Prasad
(74) *Attorney, Agent, or Firm*—Richard A. Jones

(57) ABSTRACT

A removable connector edge clip has a support plate, a first arm integrally attached to the first end of the support plate by a first bight and a second arm integrally attached to the second end of the support plate by a second bight. The first arm confronts a lower surface of the support plate in generally parallel fashion to form a panel edge clamp at the first end of the clip. The support plate has a first spring blade inclined downwardly toward the first arm and the first bight for biasingly engaging a panel edge inserted into the panel edge clamp. The first arm has a barb for retaining the panel edge inserted into the panel edge clamp. The second arm confronts an upper surface of the support plate in generally parallel fashion to form a connector attachment at the second end of the clip. The connector attachment includes a second spring blade inclined downwardly toward the second bight and the support plate and a detent tang inclined upwardly toward the second bight and away from the second arm. The support plate has an anti tangle tongue inclined upwardly toward the second bight and the second arm.

10 Claims, 1 Drawing Sheet

REMOVABLE CONNECTOR EDGE CLIP

FIELD OF THE INVENTION

This invention relates to electrical connectors and more particularly to a clip for attaching an electrical connector to the edge of a panel.

BACKGROUND OF THE INVENTION

Automotive vehicle wiring is made up of a number of wiring harnesses that are connected to each other with electrical connectors that include plastic connector bodies that hold electrical terminals attached to the ends of electrical leads. These electrical connectors are often attached to a panel edge in the vehicle body by a connector edge clip to route the wiring within the vehicle body.

The thickness of the panel edges in the vehicle body that the connector edge clips are attached to varies. This results in the use of a different connector edge clip for each panel edge thickness found in a particular vehicle body. Sometimes a particular connector edge clip can be used for a small range of panel edge thicknesses. However, even then several connector edge clips are required resulting in a proliferation of parts and increased assembly costs. Consequently there is a need for a connector edge clip that can be attached to panel edges that vary in thickness with a wide range.

During vehicle build, it is also often necessary to detach the connector edge clip from the panel edge, mate the electrical connector with the electrical connector of another wiring harness and then reattach the connector edge clip to the panel edge. Consequently there is also a need for a removable connector edge clip that not only holds the electrical connector on to the panel edge firmly but also one that is detached and reattached to the panel edge easily.

SUMMARY OF THE INVENTION

This invention provides a removable connector edge clip that can be attached to panel edges that vary in thickness within a wide range and that holds an electrical connector on the panel edge firmly while facilitating detachment and reattachment of the connector edge clip to the panel edge.

The removable connector edge clip of the invention has a clamp that can be slid on any panel edge within a wide range of thicknesses, for instance from 1 mm to 4 mm, and held firmly on the panel edge by spring blades and barbs inside the clamp. The connector edge clip includes a connector attachment for an electrical connector and is configured so that the connector edge clip can be removed from the panel edge easily by applying pressure to the electrical connector. The connector edge clip is also preferably equipped with an anti-tangle tongue that prevents the connector edge clips from tangling up with each other during the manufacturing process. The spring blades inside the clamp also preferably provide an anti-tangle feature.

DETAILED DESCRIPTION OF A PREFERRED EMBODIMENT

Figure 1:
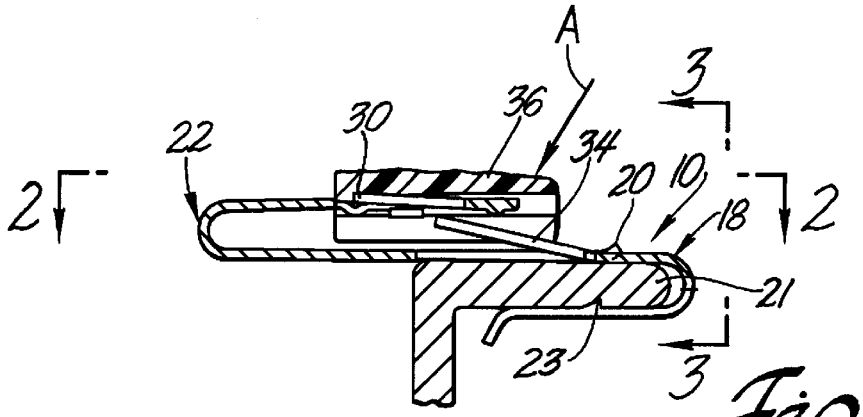
FIG. 1 is an electrical connector installation that includes a longitudinal section of a removable connector edge clip in accordance with the invention.

Referring now to the drawing, a removable connector edge clip 10 of the invention is illustrated. Edge clip 10 which is preferably made of spring tempered steel is generally S-shaped comprising a support plate 12, a first arm 14 and a second arm 16. The first arm 14 is integrally attached to a first end of support plate 12 by a first bight so that first arm 14 is spaced below support plate 12. When so attached, first arm 14 confronts a lower surface of support plate 12 in generally parallel fashion to form a panel edge clamp 18 at the first end of clip 10.

Support plate 12 has two laterally spaced spring blades 20 that are cut out of the sheet metal body of the support plate 12 and inclined downwardly toward first arm 14 and the first bight that attaches first arm 14 to support plate 12.

Figure 4:
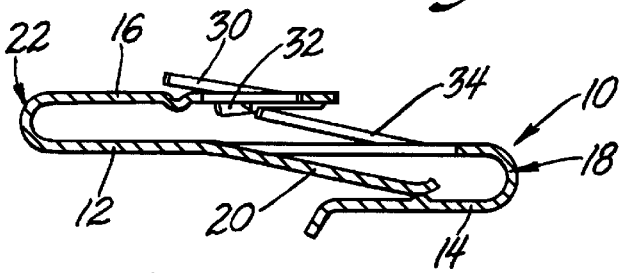
FIG. 4 is a longitudinal section of the removable connector edge clip of FIG. 1 before installation.
Figure 5:
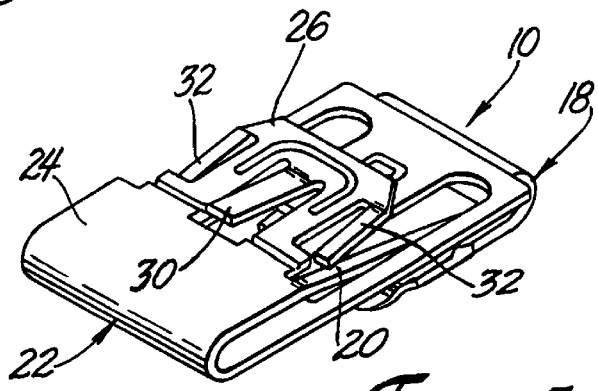
FIG. 5 is a perspective view of the removable connector edge clip shown in FIG. 1.

Spring blades 20 are attached to support plate 12 outwardly of the panel edge clamp 18 and project into panel edge clamp 18 as best shown in FIG. 4. Spring blades 20 biasingly engage a panel edge 21 that is inserted into the panel edge clamp 18 as best shown in FIG. 1. First arm 14 has a barb 23 at each side edge that digs into panel edge 21 to retain the removable connector edge clip 10 on panel edge 21 after it is inserted into panel edge clamp 18.

Figure 2:
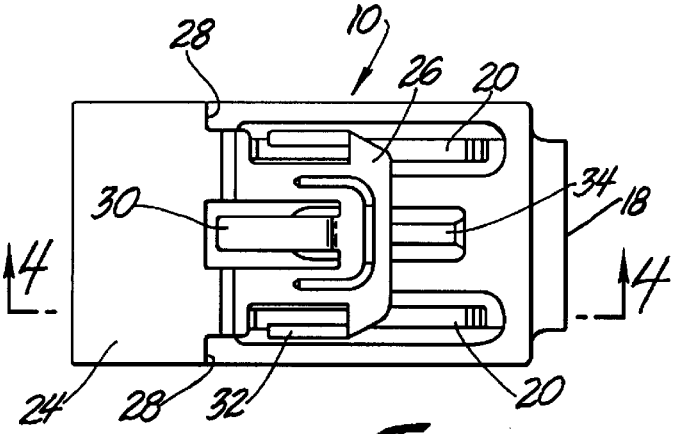
FIG. 2 is a top view of the removable connector edge clip taken along the line 2—2 of FIG. 1 looking in the direction of the arrows.

The second arm 16 is integrally attached to the second opposite end of support plate 12 by a second bight so that second arm 16 is spaced above support plate 12. When so attached, second arm 16 confronts an upper surface of support plate 12 in generally parallel fashion to form a connector attachment 22 at the second opposite end of clip 10. Connector attachment 22 operates independently of support plate 12. It has a wider portion 24 adjacent the second bight that attaches second arm 16 to support plate 12 and a narrower portion 26 at the free end so that wider portion 24 forms stop shoulders 28 as best shown in FIG. 2. Second arm 16 includes a medial detent tang 30 and two laterally spaced second spring blades 32 that are formed out of the sheet metal at the respective edges of the narrower portion 26 of second arm 16. Spring blades 32 are inclined downwardly toward support plate 12 and the second bight that attaches second arm 16 to support plate 12. Detent tang 30 is inclined upwardly toward the second bight and away from the second arm 16.

Support plate 12 preferably includes a medial anti-tangle tongue 34 that is cut out of the sheet metal of support plate 12 and inclined upwardly toward the second bight and the second arm 16. Tongue 34 does not cooperate in the mechanical attachment of an electrical connector 36 to the connector attachment 22 which relies on the stop shoulders 28, detent tang 30 and spring blades 32. The function of tongue 34 is to prevent loose connector edge clips 10 from tangling with each other during the manufacturing process, shipment and handling.

Figure 3:
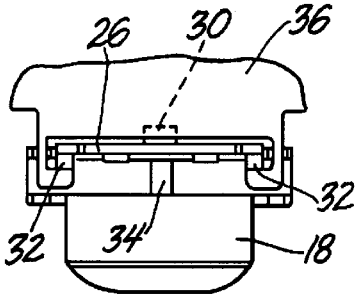
FIG. 3 is a side view of the electrical connector installation of FIG. 1 taken substantially along line 3—3 of FIG. 1 looking in the direction of the arrows.

Referring now to FIGS. 1 and 3, removable connector edge clip 10 operates as follows. Clip 10 is installed on panel edge 21 by inserting panel edge 21 into panel edge clamp 18 against the bias of spring arms 20. When fully inserted, spring blades 20-push panel edge 21 down against arm 14 where barbs 23 dig into panel edge 21 to prevent removal of clip 10. Clip 10, however, may be removed with the assistance of electrical connector 36 as explained below. In any event, panel edge clamp 18 accommodates panel edge within a range of thicknesses due to the presence of spring blades 20. For instance we have found that a removable connector edge clip of our invention can be firmly attached to panel edges that varied from 1 mm to 4 mm.

After removable connector edge clip 10 is installed, electrical connector 36 is pushed onto connector attachment 22. Clip 10 is an S-shape configuration so that electrical connector 22 is pushed onto connector attachment 22 in the same direction as clip 10 is pushed onto panel edge 21. Thus the electrical connector installation does not disturb the clip installation on panel edge 21 and in fact tends to enhance the clip installation. Connector 36 is pushed onto the narrower end portion 26 until stop shoulders 28 are engaged. When installed, detent tang 30 engages an internal shoulder of electrical connector 36 to prevent pull-off as best shown in FIG. 1. Spring blades 32 also biasingly engage internal longitudinal surfaces of electrical connector 36 to attach the electrical connector 36 to clip 10 firmly. After complete installation, electrical connector 36 can be removed by depressing detent tang 30 (with suitable tools that are well known) and pulling electrical connector 36 off connector attachment 22. This is a tedious and time-consuming job. However, connector edge clip 10 with electrical connector 36 still attached can be removed from panel edge 21 easily with assistance of the attached electrical connector 36 by pressing down on connector 36 aft of second arm 16 as indicated by arrow A in FIG. 1. This exerts a clockwise movement on clamp 18 that opens clamp 18 and reduces the clamping force of spring arms 20 as well as the grip of barbs 23. Downward force applied to electrical connector 36 aft of arm 16 thus facilitates removal of connector edge clip 10 from panel edge 21.

Electrical connector 36 may be mated to the electrical connector of another wiring harness after which connector edge clip 10 is simply reattached to panel edge 21 by sliding clamp 18 onto the panel edge.

Clip 10 with connector attachment 22 is designed for use with electrical connectors having a clip attachment comprising an open slot with sidetracks such as illustrated with electrical connector 36. This configuration allows a maximum anti tangle tongue 34 that does not interfere with installation of the electrical connector 36 onto connector attachment 22. However, electrical connectors with a closed clip attachment slot can be used. In this case, the interference can be tolerated and/or the anti tangle tongue 34 can be shortened.

What is claimed is:

1. A removable connector edge clip comprising:

a support plate having a first end and a second end, a first arm integrally attached to the first end of the support plate by a first bight so that the first arm is spaced below the support plate, the first arm confronting a lower surface of the support plate in generally parallel fashion to the lower surface to form a panel edge clamp at the first end, the support plate having a first spring blade inclined downwardly toward the first arm and the first bight for biasingly engaging a panel edge inserted into the panel edge clamp, a second arm integrally attached to the second end of the support plate by a second bight so that the second arm is spaced above the support plate, and the second arm confronting an upper surface of the support plate in generally parallel fashion to the upper surface to form a connector attachment at the second end.

2. The removable connector edge clip as defined in claim 1 wherein the clip is generally S-shaped and the connector attachment includes a second spring blade inclined downwardly toward the second bight and the support plate and a detent tang inclined upwardly toward the second bight and away from the second arm, and the support plate has an anti tangle tongue inclined upwardly toward the second bight and the second arm.

3. The removable connector edge clip as defined in claim 1 wherein the first arm is shorter than the support plate and the first spring blade is attached to the support plate outwardly of the panel edge engaging clamp.

4. The removable connector edge clip as defined in claim 2 wherein the second arm is shorter that the support plate and the anti-tangle tongue is attached to the support plate at a distance spaced from the free end of the second arm.

5. The removable connector edge clip as defined in claim 3 wherein the second arm is shorter that the support plate and the anti-tangle tongue is attached to the support plate at a distance spaced from the free end of the second arm.

6. The removable connector edge clip as defined in claim 5 wherein the clip is generally S-shaped, the support plate has two first spring blades that are laterally spaced from each other, and the connector attachment has two second spring blades that are laterally spaced from each other.

7. A removable connector edge clip comprising:

a support plate having a first end and a second end, a first arm integrally attached to the first end of the support plate by a bight so that the first arm is spaced below the support plate, the first arm being shorter that the support plate and confronting a lower surface of the support plate in generally parallel fashion to the lower surface to form a panel edge clamp at the first end, the first arm having barbs at respective side edges the support plate having first spring blades attached to the support plate outwardly of the panel edge clamp, the first spring blades being inclined downwardly toward the first arm and the first bight for biasingly engaging a panel edge inserted into the panel edge clamp against the barbs of the first arm, a second arm integrally attached to the second end of the support plate by a second bight so that the second arm is spaced above the support plate, the second arm being shorter than the support plate and confronting an upper surface of the support plate in generally parallel fashion to the upper surface to form a connector attachment at the second end, the connector attachment further including second spring blades inclined downwardly toward the second bight and the support plate, and the connector attachment further including a detent tang inclined downwardly toward the second bight and away from the second arm.

8. The removable connector edge clip as defined in claim 7 wherein the detent tang is longer than the second spring blades, the second arm has a wider portion adjacent the second bight and a narrower portion at the free end, the wider portion forming stop shoulders and the second spring blades being at the respective edges of the narrower portion.

9. The removable connector edge clip as defined in claim 7 wherein the support plate has an anti tangle tongue that is attached to the support plate at a location spaced away from the free end of the second arm and that is inclined upwardly toward the second bight and the second arm.

10. The removable connector edge clip as defined in claim 8 wherein the support plate has an anti-tangle tongue that is attached to the support plate at a location spaced away from the free end of the second arm and that is inclined upwardly toward the second bight and the second arm.

* * * * *